United States Patent [19]

Grove

[11] Patent Number: 4,792,017

[45] Date of Patent: Dec. 20, 1988

[54] ADJUSTABLE SUPPORT FOR LADDERS, SCAFFOLDS AND THE LIKE

[76] Inventor: Thomas S. Grove, 53 Kevin Dr., York, Pa. 17404

[21] Appl. No.: 191,610

[22] Filed: May 9, 1988

[51] Int. Cl.[4] ..... E06C 7/44

[52] U.S. Cl. ..... 182/204; 248/188.4

[58] Field of Search ..... 182/204, 205, 201, 202; 248/188.4

[56] References Cited

U.S. PATENT DOCUMENTS

| | | | |
|---|---|---|---|
| 898,973 | 9/1908 | Curran | 182/205 |
| 971,997 | 10/1910 | Henning | 182/205 |
| 1,197,727 | 9/1916 | Finkle | 182/201 |
| 2,203,114 | 6/1940 | Vecker | 182/179 |
| 2,618,496 | 11/1952 | Johnson | 182/201 |
| 3,021,921 | 2/1962 | Poelvoorde | 182/201 |
| 3,697,032 | 10/1972 | Pearce | 182/201 |
| 4,029,174 | 6/1977 | Planck | 182/204 |
| 4,069,893 | 1/1978 | Blackstone | 182/204 |
| 4,090,586 | 5/1978 | Pears | 182/204 |
| 4,209,078 | 6/1980 | Gerber | 182/204 |

*Primary Examiner*—Reinaldo P. Machado
*Attorney, Agent, or Firm*—C. Hercus Just

[57] ABSTRACT

An elongated longitudinally adjustable load-supporting unit attachable to one end of one or both legs of a ladder or at least selected legs of a scaffold to permit using the ladder or scaffold on uneven surfaces, the load-supporting unit comprising an elongated externally-threaded member threadably received within an internally-threaded block-like member split into two similar halves which are pivotally connected adjacent one end and are urged into abutting relationship by spring means, and handle-like members extend respectively in similar directions from the halves of the block-like member and are operable to separate the internally-threaded portions of the block-like member sufficiently to permit free longitudinal movement of the externally-threaded member relative to the pivotally-connected halves of the block-like member. The load-supporting units are connectable to the lower ends of the sides of a ladder or legs of a scaffold between pairs of axially-aligned guide bearings which receive the elongated threaded members therethrough.

10 Claims, 2 Drawing Sheets

ADJUSTABLE SUPPORT FOR LADDERS, SCAFFOLDS AND THE LIKE

BACKGROUND OF THE INVENTION

Ladders, scaffolds and similar devices are used extensively on construction sites, as well as in buildings. Especially in outdoor locations, the ground upon which the ladders and scaffolds are used very frequently is uneven, while it is necessary to have similar support for both legs of a ladder, as well as all of the legs of a scaffold. Many efforts have been made in the past to supply adjustable devices of various kinds for use in relation to ladders, as well as scaffolds, for purposes of enabling both legs of a ladder, and preferably all the uprights or legs of a scaffold, to be disposed upon firm support, even though the load-bearing surface is of an uneven nature.

The following patents disclose examples of adjustable supports for the legs of a ladder in order that both legs might be firmly positioned upon an otherwise uneven surface:

| | |
|---|---|
| U.S. Pat. No. 898,973 - Curran | 1908 |
| U.S. Pat. No. 971,997 - Henning | 1910 |
| U.S. Pat. No. 1,197,727 - Finkle | 1916 |
| U.S. Pat. No. 3,021,921 - Poelvoorde et al | 1962 |
| U.S. Pat. No. 4,029,174 - Planck et al | 1977 |

Patents pertaining to scaffolds to adapt them to uneven surfaces:

| | |
|---|---|
| U.S. Pat. No. 2,203,114 - Uecker et al | 1940 |
| U.S. Pat. No. 2,618,496 - Johnson | 1952 |
| U.S. Pat. No. 3,697,032 - Pearce | 1972 |

It will be seen from the foregoing patents that various means have been resorted to to effect adjustment of the lower ends of the legs of a ladder and uprights of a scaffold, some of these involving various types of threaded arrangements, while others, for example, utilize ratchet means of different types. Some of these are quick-acting, while others require somewhat time-consuming threaded adjusting means. The present invention provides improvements over the above-referred to adjustable mechanisms embodied in the foregoing listed patents, as well as many other patents which were considered, but from which the foregoing were selected as being representative.

SUMMARY OF THE INVENTION

It is among the principal objects of the present invention to provide an elongated longitudinally-adjustable load-supporting unit which is attachable to one end of one or both legs of a ladder or at least two selected legs or vertical supports of a scaffold to permit the use of the ladder or scaffold on uneven surfaces. One common location for using a ladder on uneven surfaces comprises supporting the ladder on a set of stairs, such as in painting a hallway or the like. The load-supporting unit comprising the present invention consists of an elongated, externally-threaded member which is threadably received within an internally-threaded block-like member, split preferably into two similar halves which are pivotally connected adjacent one end and are urged into abutting relationship by spring means, while handle-like members extend respectively in similar directions from the halves of the block-like member and are operable to separate the internally-threaded portions of said members sufficiently to permit free longitudinal movement of the externally-threaded members relative to the pivotally-connected halves of the block-like member.

Another object of the invention is to mount the above-described adjustable load-supporting unit between a pair of guide bearings axially-aligned with the internally-threaded block-like member and respectively extending from opposite upper and lower surfaces of the block-like member, said guide bearings being firmly bolted or otherwise connected to the lower ends of the opposite legs of a ladder or at least to selected upright members of a scaffold, whereby the externally-threaded support members may be quickly adjusted to uneven surfaces upon which the ladder or scaffold is to be supported and then, by releasing the handle-like members, the opposite halves or jaws of the block-like member quickly are brought into abutting relationship to firmly and threadably engage the elongated, externally-threaded member of which the lower end abuts a load-bearing surface.

A further object of the invention is to employ either standard threads which are V-shaped in cross-section or so-called Acme threads which, in cross-section, have parallel opposed surfaces and avoid any possibility of the V-shaped threads permitting camming functions under abnormally heavy loads, and thereby causing the opposite halves of the internally-threaded member to separate. Such separation also can be minimized by the employment of spring means of sufficient strength to prevent such camming action under normal, reasonable loads.

Details of the foregoing objects, as well as the invention, are set forth in the following specification, and illustrated in the accompanying drawings.

DETAILED DESCRIPTION OF THE PREFERRED EMBODIMENTS OF THE INVENTION

Figure 1:
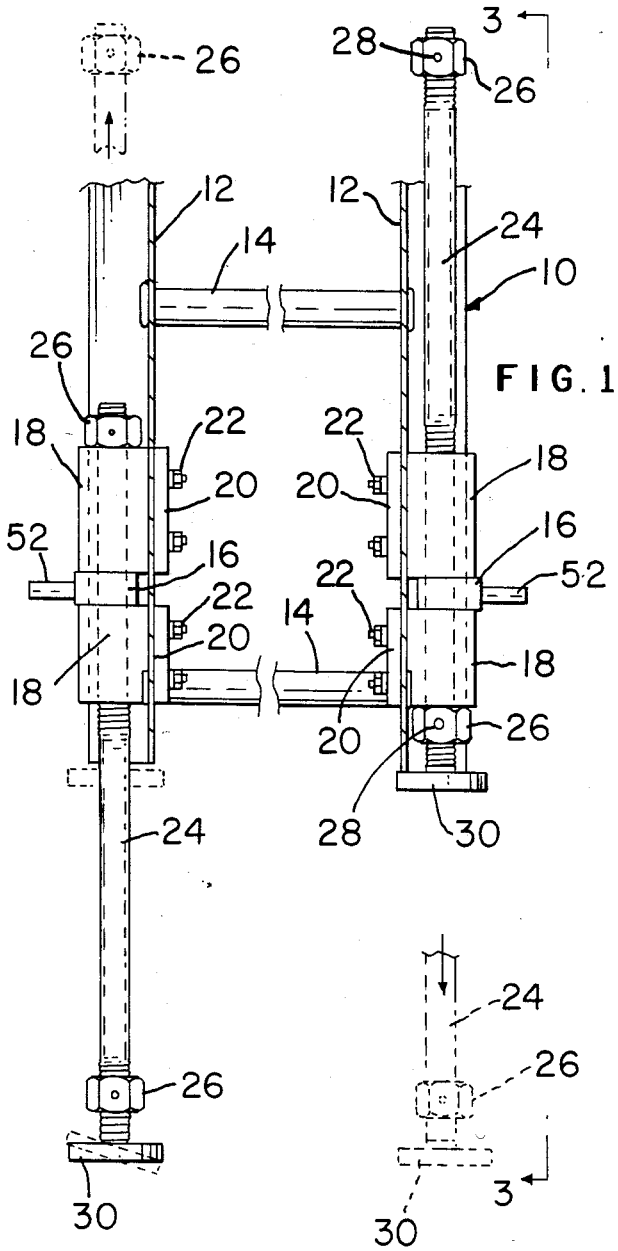
FIG. 1 is a front elevation illustrating a fragmentary lower portion of a ladder to which adjustable load-supporting units embodying the invention are included and showing the adjustable member of the supporting unit on one leg of the ladder at a different location from that on the other legs.
Figure 4:
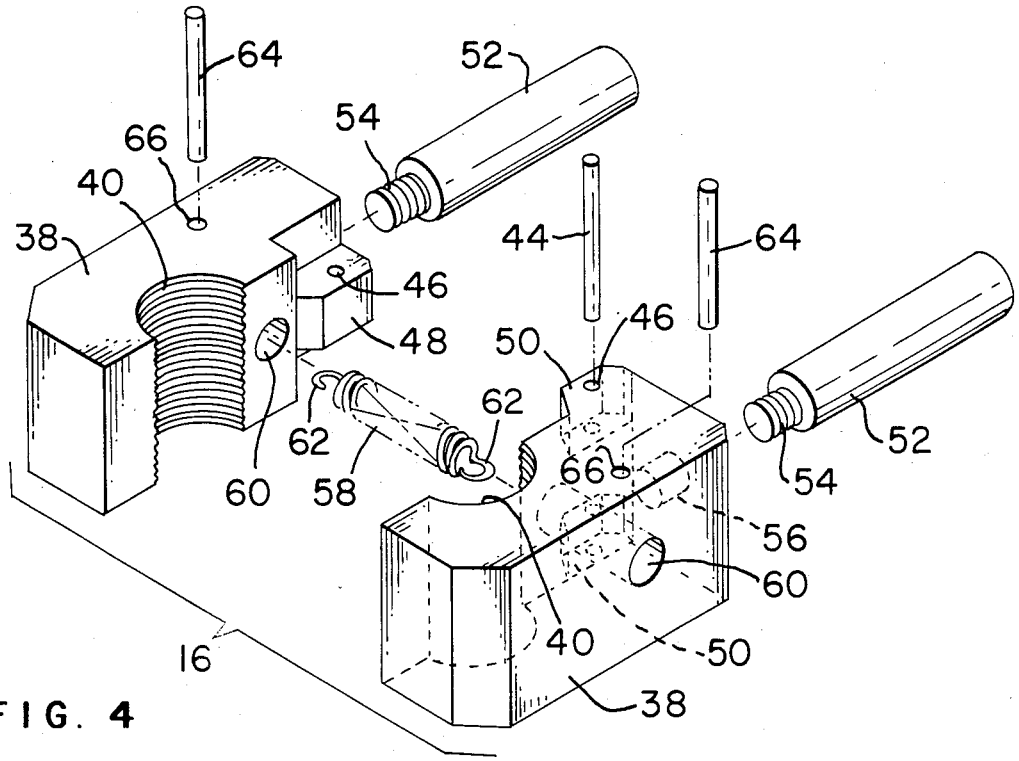
FIG. 4 is an exploded view of the internally-threaded adjustable member of the load-supporting unit embodying the invention.
Figure 5:
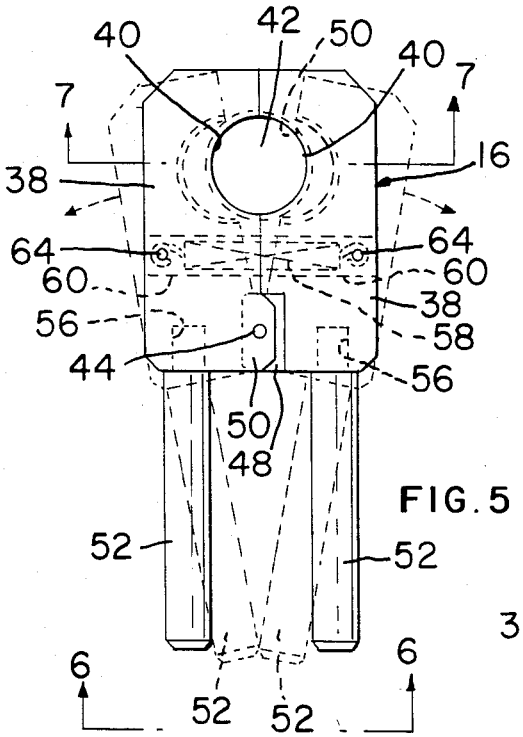
FIG. 5 is a top plan view of the assembled elements shown in FIG. 4, comprising pivotally-connected halves of the internally-threaded member of the adjustable load-supporting unit and, in phantom, said view illustrating the pivoted halves of the block-like member of the internally-threaded member being separated to permit ready longitudinal movement of the externally-threaded member through the separated halves of the internally-threaded portions of the block-like member.
Figure 6:
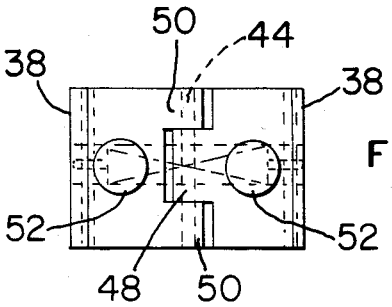
FIG. 6 is a bottom plan view of the internally-threaded member, as seen on the line 6—6 of FIG. 5.

Referring to FIG. 1, it will be seen that details of the present invention are attached to the lower end portions of the legs of an exemplary ladder 10, the legs 12 thereof comprising fragmentary lower portions of a so-called aluminum or metal ladder, such as those in wide use at present. The rungs 14 of the ladder have been broken midway to condense the illustration and readily adapt it to the sheet of drawing. The elongated longitudinally-adjustable load-supporting units 16 of the invention, details of which are best shown in FIGS. 4–6, are illustrated in FIG. 1 as being positioned between a pair of axially-aligned bearing members 18. The bearing members 18 readily are connected within the channel-like legs 12 of the ladder and suitable bolts extend through the members 18, as well as clamping plates 20, which are mounted on the inner, exterior surface of the channels of legs 12 and are secured to the bearing members 18 by appropriate nuts and bolts 22. The bearing members 18 which have longitudinally-aligned openings therein, slidably receive elongated, externally-threaded members 24 of suitable length, such, for example, that have substantially more than the distance between adjacent rungs 14 of the ladder.

Opposite ends of the externally-threaded members 24 are provided with similar locking members 26 which may comprise threaded nuts and fixed against rotation by appropriate cotter pins 28 to prevent accidental position displacement and prevent accidental removal of the members 24 from the guide bearings 18. If desired, the lower ends of the externally-threaded members 24 may be provided with appropriate feet members 30, which preferably are substantially greater in diameter than the externally-threaded members 24, as can be visualized especially from FIG. 1 and FIG. 3.

Figure 3:
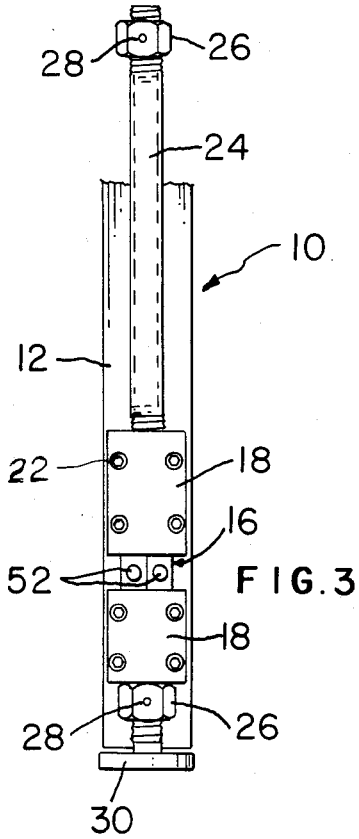
FIG. 3 is a side elevation of FIG. 1, as illustrated by the line 3—3 of FIG. 1.
Figure 2:
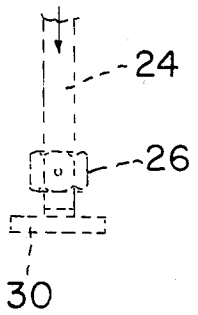
FIG. 2 is a front elevation of a simple scaffold unit to opposite legs of which adjustable load-supporting units of the invention have been adapted.
Figure 2:
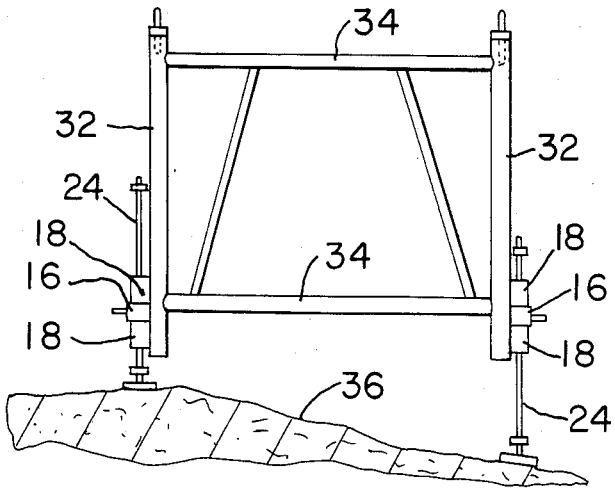

Referring to FIG. 2, wherein an exemplary, relatively simple scaffold is illustrated to show the possibility of the application of the present invention to the vertical members of the scaffold, it will be seen that the outermost vertical members 32 are each provided with adjustable load-supporting units 16, which are positioned between vertical bearing members 18, as in the embodiment shown in FIGS. 1 and 3, and elongated externally-threaded members 24 are adjustably secured in different vertical positions in order to maintain the horizontal members 34 of the scaffold preferably at a horizontal position, notwithstanding the substantial slope of the load-bearing terrain 36 comprises quite a slope.

Referring now to FIGS. 4–6, and initially to FIG. 5, it will be seen in the full line illustrations that the adjustable load-supporting unit 16 essentially comprises a block, which is split into two similar halves 38, shown in detail in FIG. 4. The halves 38 are complementary to each other and each of the same have one-half of the internally-threaded section 40 which, when the two halves 38 abut each other, as shown in full lines in FIG. 5, the halves of the internally-threaded sections 40 comprise a single, internally-threaded aperture 42, which is threadably complementary to the external threads of the elongated externally-threaded members 24. Further, the threads have an adequate depth to afford substantial engagement with the externally-threaded members 24 when the halves 38 of the block-like load-supporting unit 16 are in abutting relationship, as shown in FIG. 5. However, for purposes of rapidly disengaging the externally-threaded member 24, it will be seen that the halves 38 of the block-like member 16 are pivotally connected at one side by means of a pivot pin 44 which extends through interfitting tangs 48 and 50 through which the aligned holes 46 extend to receive pivot pin 44. As illustrated, there is a single tang 48 on one of the halves 38, while there is a pair of spaced tangs 50 on the other half 38 and the space between the two is made to closely accommodate the single tang 48.

When halves 38 of the block member 16 are pivotally separated especially to the extent illustrated in phantom in FIG. 5, there is adequate clearance between the internal-threaded sections 40 and the external threads of elongated members 24 to permit the members 24 readily to be moved axially through the separated sections 40 as can be visualized by the phantom broken circle 50, shown in FIG. 5.

Pivoted separative movement of the two halves 38 of the block member 16 preferably is accomplished by manipulating handle-like members 52, which are specifically illustrated as short rods 52, having short threaded ends 54 of smaller diameter than the rods 52, said threaded ends being received within internally-threaded sockets 56 formed in similar sides of the pivotally-connected halves 38 of the block-like member 16. As an alternative, if desired, the halves 38 of the block-like member 16 may be cast integrally with suitable handle members similar to handle members 52, as long as the same extend away from the pivot 44 in the direction opposite the location of the internally-threaded aperture 42.

For purposes of maintaining the halves 38 of the block-like member 16 in abutting relationship, an appropriate spring 58 is disposed within circular bores 60, in alignment with each other respectively in the halves 38 of the block-like member 16, and opposite ends of the spring 58 have hooks or loops 62, which are on the opposite outer ends of the spring and are adapted to receive securing pins 64, which are mounted within holes 66 respectively in the halves 38 and when mounted therein, extend through the hooks or loops 62 of the ends of the spring 58.

It is to be noted that the spring 58 is of the tension type and the strength thereof is selected to be such as normally to maintain the two halves 38 of the block-like member 16 firmly in abutting relationship. This is accomplished by initially placing the spring 58 under limited tension when assembling the ends of the same with the pin 64.

Figure 7:
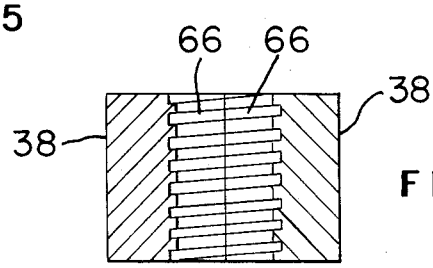
FIG. 7 is a vertical sectional view through the full line version of FIG. 5, as seen on the line 7—7 thereof, and illustrating Acme threads.

As an additional means to minimize the possibility of any tendency for the V-shaped threads, such as shown in FIG. 4, being induced by tension to be cammed apart when a load is applied on the externally-threaded members 24, further, it is proposed, as shown in FIG. 7, to employ Acme threads 66 instead of V-shaped threads, as illustrated in FIG. 4, inasmuch as the opposite surfaces of the Acme threads are parallel to each other and thus, would not induce any tendency to cam the two halves 38 apart in any manner, which would permit the elongated member 24 to move axially through the separated thread sections of the members 38.

It will be noted especially from FIG. 5 that the spring 58 is disposed transversely between the halves 38 of the members 16 and the same is on an axis that is perpendicular to the surfaces of the halves 38 which abut each other. Said axis also is between the pivot pin 44 and the internally-threaded aperture 42, as best shown in FIG. 5, and preferably, said axis is disposed closer to the threaded aperture 42 than the pivot pin 44, in order to enhance the mechanical advantage to maintain the abuttable surfaces of the halves 38 in abutment with each other.

From the foregoing, it will be seen that the present invention provides adjustable means for providing the opposite sides of a ladder or spaced vertical frame members of a scaffold in substantially vertical position, regardless of the irregularity of the surface upon which the legs of the ladder or of the scaffold are intended to engage for support. Simply by moving a pair of handle-like members toward each other, the locking effect of the internal-threaded halves of the block-like member 16 are removed sufficiently from engagement with the externally-threaded elongated members 24 to permit quick adjustment which is readily maintained upon release of the handle-like members, and further to sustain engagement of the internally-threaded sections with the externally-threaded longitudinal member, it is further contemplated that the Acme threads may be employed in lieu of V-shaped threads.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An elongated longitudinally-adjustable load-supporting unit comprising in combination, an externally-threaded elongated member of uniform diameter, an internally-threaded member having threads complementary to the external threads of said elongated member, and coengageable therewith for a limited portion of the length of said elongated member, said internally-threaded member being bifurcated and the parts thereof being pivotally-connected for separative movement of said parts, spring means interconnected to said parts in a manner to urge said parts firmly together to effect threaded coengagement of the internal threads thereof with the external threads of said elongated member, and means operable in opposition to said spring means to spread the internally-threaded portions of said parts into a spaced relationship sufficient to permit free relative longitudinal movement between said members.

2. The load-supporting unit according to claim 1 in which said internally-threaded member is a block split into two similar halves, the internally-threaded aperture extending between the normally upper and lower ends of the member and the pivotal connection comprising a hinge-like connection adjacent one side of said block.

3. The load-supporting unit according to claim 2 in which said means operable to spread said internally-threaded portions of said parts comprising handle-like members respectively extending in similar directions from said halves of said block at the side of said block adjacent said hinge-like connection.

4. The load-supporting unit according to claim 2 in which said spring means is a tension spring and extends along an axis transverse to the abutting surfaces of said halves of said block at a location between said hinge-like connection and said internally-threaded aperture.

5. The load-supporting unit according to claim 4 in which opposite end portions of said spring are disposed in axially-aligned sockets respectively formed in said halves of said block and the ends of said spring respectively being anchored to said halves of said block.

6. The load-supporting unit according to claim 1 in which said complementary internal and external threads are Acme threads in which the opposite surfaces thereof in section are parallel.

7. The load-supporting unit according to claim 1 in close combination with a pair of guide bearings mountable in axial alignment with the threads of said internally-threaded member and extending in opposite directions therefrom and slidably receiving said externally-threaded member, and means on said guide bearings connectable to a load-supporting member adjacent the end thereof adapted to engage a load-bearing surface.

8. The load-supporting unit according to claim 7 in which said load-supporting unit is a ladder having opposite side members and load-supporting units according to claim 7 respectively secured to the ends of said side members adjacent the normally load-bearing surface-engaging ends thereof.

9. The load-supporting unit combined with a ladder according to claim 8 in which the opposite ends of said externally-threaded members have locking members thereon operable to engage opposite ends of said guide bearings and thereby limit the longitudinal movement of said externally-threaded members relative to the lower ends of the side members of said ladder.

10. The load-supporting unit according to claim 7 in which said load-supporting unit is a scaffold having a plurality of normally vertical load-supporting members spaced transversely apart, and load-supporting units according to claim 7 respectively secured to the ends of at least certain of said load-supporting members respectively adjustable thereon to engage surfaces to support said scaffold.

* * * * *